United States Patent [19]

Leon

[11] 4,154,468

[45] May 15, 1979

[54] SAFETY DEVICES FOR DOOR LOCKS OF THE SPRING-LOADED, SLIDING BOLT TYPE

[76] Inventor: Luis G. Leon, 338 Cambridge Ave., P.O. Box 321, Westbury, N.Y. 11590

[21] Appl. No.: 841,075

[22] Filed: Oct. 11, 1977

[51] Int. Cl.[2] ..... E05C 21/00

[52] U.S. Cl. ..... 292/346

[58] Field of Search ..... 292/346, 340; 70/416, 70/418

[56] References Cited

U.S. PATENT DOCUMENTS

| | | | |
|---|---|---|---|
| 1,051,530 | 1/1913 | Whalen | 292/54 |
| 1,727,323 | 9/1929 | Bartlett | 292/346 |
| 2,692,158 | 10/1954 | Tirschel | 292/346 |
| 3,825,291 | 7/1974 | Sprunger | 292/346 |
| 3,895,834 | 7/1975 | Grinbaum et al. | 292/346 |

FOREIGN PATENT DOCUMENTS

| | | | |
|---|---|---|---|
| 269076 | 4/1927 | United Kingdom | 292/346 |

*Primary Examiner*—Richard E. Moore

*Attorney, Agent, or Firm*—Ladas, Parry, Von Gehr, Goldsmith & Deschamps

[57] ABSTRACT

A device for rendering a spring-loaded, sliding bolt lock resistant to tampering comprises a sheet form member which can be mounted between the door stile and the door jamb and is formed with slots so that when a strip of pliable material is inserted between the door stile and the door jamb at a position spaced from the lock and is moved towards the lock, the leading edge of the sheet engages one of the slots in the member.

8 Claims, 5 Drawing Figures

SAFETY DEVICES FOR DOOR LOCKS OF THE SPRING-LOADED, SLIDING BOLT TYPE

This invention relates to safety devices for door locks of the spring-loaded, sliding bolt type.

It is common practice for a hotel to fit the doors of its guest rooms with door locks of the spring loaded, sliding bolt type. The lock is mounted on the door stile (i.e. that edge of the door which is adjacent the door jamb when the door is closed) and has a bolt which is spring biased towards its locking or extended position. The door jamb is provided with a striker plate, and the bolt has a camming surface which engages the striker plate as the door is closed to push the bolt back into the lock, against the spring bias, until the door is fully closed whereupon the bolt automatically springs out into a hole in the door jamb.

This type of lock has the advantage that it operates automatically when the door is closed and it is not necessary to turn a key in the lock in order to effect locking. Thus, this type of lock is widely used in hotels in order to guard the guests against their own forgetfulness. However, the lock is subject to the disadvantage that if a gap is left between the door stile and the jamb, when the door is in the closed position, a thin strip of celluloid or other pliable material can be inserted into the gap and brought into engagement with the camming surface of the bolt. By manipulating the strip of pliable material the bolt can be pushed back into the lock, thus enabling the door to be opened. This problem is rendered particularly acute when the door is provided with a self-closing device, for closing the door automatically, since doors provided with such devices are frequently also equipped with rubber silencer stops in order to prevent the door stile from banging against the jamb when the door closes. The presence of such stops ensures that there will always be a gap between the door stile and the jamb, which is sufficient to enable the insertion of a strip of pliable material.

Numerous solutions have been proposed in order to solve the problem of spring-loaded, sliding bolt type locks being vulnerable to tampering. According to one proposal, the striker plate is provided with a fitting designed to full the gap between the door stile and the jamb in the region of the hole in the door jamb. The purpose of this fitting is to prevent the insertion of a pliable strip into the gap, and in order to assist in achieving this object the fitting is provided with a series of grooves to impede progress of the strip if the tamperer is successful in introducing the strip into the gap. However, this fitting does not protect the lock against use of a pliable strip which is inserted into the gap somewhat above the striker plate and then drawn downwardly until it engages the camming surface of the bolt. So long as there is some gap between the fitting and the door stile, and it is in practice inevitable that some gap will remain, a skilled tamperer will still be able to open the door. Another protective device is disclosed in U.S. Pat. No. 1,727,323 (Bartlett). This prior proposal employs hook shaped stops above and below the hole in the door jamb. The stops are intended to prevent a strip of pliable material from being worked up or down the gap between the door stile and the jamb into engagement with the camming surface of the bolt. This device is subject to the disadvantage that it presents only four obstructions to the strip (two above the bolt and two below the bolt) and does not lend itself to modification to present substantially more than four obstructions.

According to one aspect of the present invention there is provided a device for rendering a spring loaded, sliding bolt lock resistant to tampering, comprising a sheet form member which can be mounted between the door stile and the door jamb and is formed with slots so that when a strip of pliable material is inserted between the door stile and the door jamb at a position spaced from the lock and is moved towards the lock, the leading edge of the sheet engages one of the slots in said member.

According to another aspect of the present invention there is provided a structure comprising a door having a door stile, a spring-loaded, sliding bolt lock fitted to the door stile, a door jamb adjacent to the door stile, and a sheet form member which is disposed between the door stile and the door jamb and has an edge which is spaced from the bolt of the lock and extends transversely to the door stile and the door jamb, said sheet form member extending from said edge towards the bolt of the lock and being formed in said edge with slots extending substantially parallel to the door stile and the door jamb, said slots terminating at positions spaced from said bolt.

As used herein, the term "door stile" does not have a restrictive meaning but is used generally to denote that edge of a door which is adjacent the door jamb when the door is in its closed position. Also, except when the context requires otherwise, references to the door stile and the door jamb refer to those elements when the door is in its closed position. References to a "suitable strip of pliable material" refer to a strip of pliable material which is thin enough and flexible enough to be introduced into the gap between the door stile and the door jamb but is stiff enough to be capable of urging the bolt back into the lock. References to the "forward end" of a strip of pliable material refer to that end of the strip which is introduced first into the gap between the door stile and the door jamb and references to the "leading edge" of the strip relate to the situation in which the strip is introduced into the gap at a position spaced from the bolt and refer to that edge of the strip which is nearer the bolt when the strip has been introduced.

For a better understanding of the invention, and to show how the same may be carried into effect, reference will now be made, by way of example, to the accompanying drawings in which.

Figure 1:
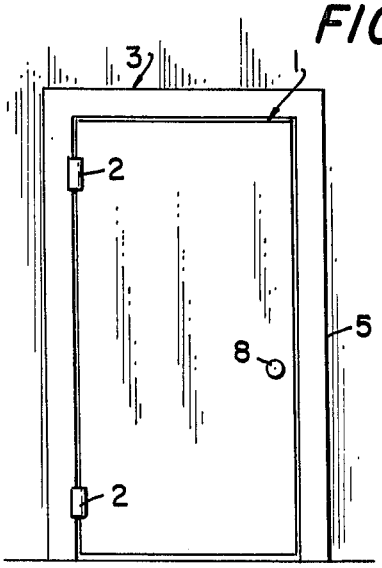
FIG. 1 illustrates a front elevation of a door fitted in a door frame.

The drawings illustrate a door 1 mounted by means of hinges 2 in a frame 3. The door has a stile 4 which is adjacent the jamb 5 of the frame 3 when the door is in its closed position. Fitted in the door stile 4 is a spring-loaded, sliding bolt lock 6, having a bolt 7. The lock has a knob 8 on one side of the door and a key plate 9 on the other side. The bolt 7, which has a camming surface 14, is spring biased towards its locking or extended position, and can be retracted either by turning the door knob 8 or by introducing an appropriate key into the lock 6, by way of a keyhole formed in the key plate 9, and turning the key.

A striker plate 10, a fitting 16 and two sheet metal members 20 are secured to the door jamb by means of two screws 26. The door jamb is formed with a hole 11, and the striker plate 10 has an aperture 12 which registers with the hole 11. The striker plate also has a bevelled camming edge 13.

When the door is open and is swung towards its closed position, the camming surface 14 of the bolt 7 engages the camming edge 13 of the striker plate 10, thus urging the bolt 7 into the lock and enabling the door to move further towards its fully-closed position. When the door is in its fully closed position, the aperture 12 in the striker plate and the hole 11 in the door jamp permit the bolt 7 to spring out of the lock, to its locking position.

The fitting 16 is provided in order to render the lock resistant to tampering, and is designed to fill the clearance left between the door stile and the door jamb when the door is in its fully closed position. The fitting 16 is of L-shaped section, the base of the L being positioned against the outermost lip 15 of the door jamb and the leg of the L being positioned against the striker plate.

The base of the L of the fitting 16 is of such a thickness as to fill substantially the entire clearance between the outermost lip 15 of the door jamb 5 and the door stile 4 when the door is in its fully closed position. As indicated above, it is virtually inevitable that there is such a gap, particularly when silencer stops are provided in conjunction with a door having a self-closing device. The leg of the fitting is formed with grooves 19 which are shaped and positioned to impede insertion of a strip of pliable material towards the bolt 7 through such clearance as may be left between the base of the L and the door stile.

Figure 3:
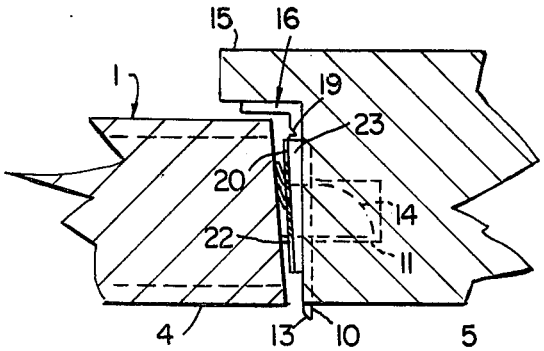
FIG. 3 shows a second horizontal view of the door, taken along a different section line.
Figure 5:
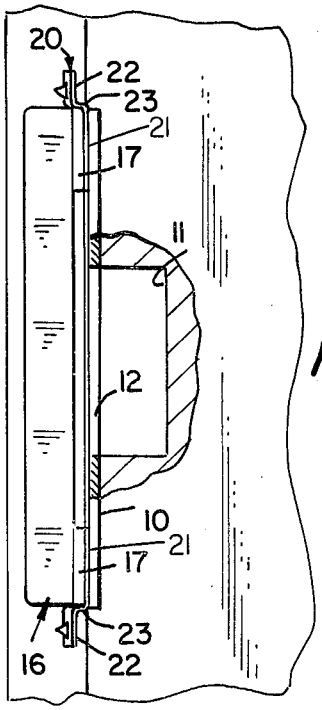
FIG. 5 shows a front elevation of the door jamb and door stile.

Each of the sheet metal members 20 comprises first and second planar portions 21 and 22, connected together by a web portion 23. The fastening holes for securing the members to the door jamb 5 are formed in the portions 21, and the portions 22 are each formed with a plurality of slots 24. The slots extend through the portions 22 at about 45° to the plane of the portions 22, as shown in FIG. 3 of the drawings. The slot that is nearest the lip 15 of the door is spaced ¼ inch from the edge of the portion 22 that is nearer the lip. That edge of the portion 22 is substantially aligned with the edge of the striker plate that is nearer the lip. The slots are ⅛ inch deep, and adjacent slots are spaced at 3/32 inch. Each of the portions 22 is also formed with two V-shaped cuts 25, the point of the V being directed towards the lip 15 of the door jamb, and that part of the sheet metal which is included between the limbs of the V is bent out of the plane of the portion 22, away from the door jamb. It will be appreciated that in view of the inclination of the slots, and the provision of the V-shaped cuts, the two metal members 20 are not identical and therefore are not interchangeable.

The combination of the fitting 16 and the sheet metal members 20 protects the lock effectively against tampering by insertion of a strip of pliable material. If, in order to avoid the grooves 19 in the leg of the fitting 16, the strip of pliable material is introduced into the gap between the door jamb and the stile at a position above or below the lock, and is drawn towards the bolt, the leading edge of the strip will lodge in one of the slots of the upper or lower member, depending upon whether the strip was introduced above or below the lock. Although it is conceivable that the strip could be manipulated out from the slot and then drawn further towards the lock, it is in practice very difficult to do so since the tamperer cannot see the slot or the leading edge of the strip of pliable material.

It the tamperer attempts to avoid the slots 24, and the grooves of the fitting 16, by introducing the strip of pliable material at the level of the planar portion 22, he will be foiled in his attempt to introduce the strip by virtue of the forward end of the strip engaging one or other of the V-shaped, bent out parts.

Figure 4:
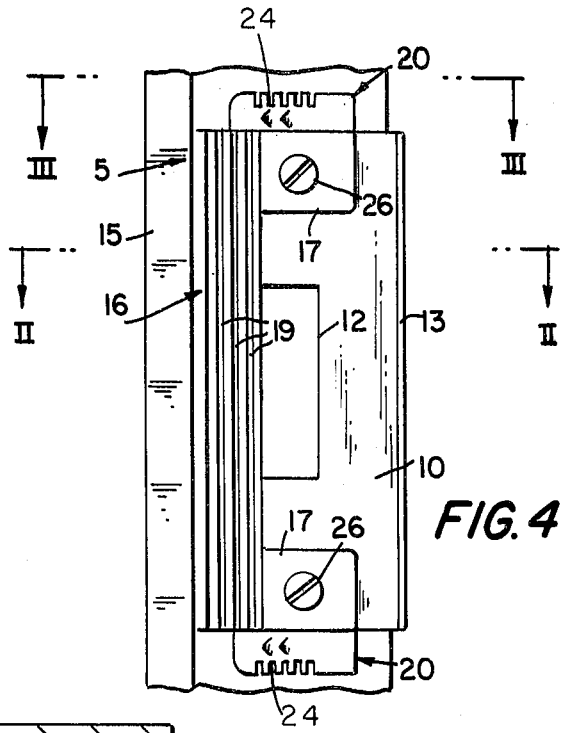
FIG. 4 shows a side elevation of the door jamb.
Figure 2:
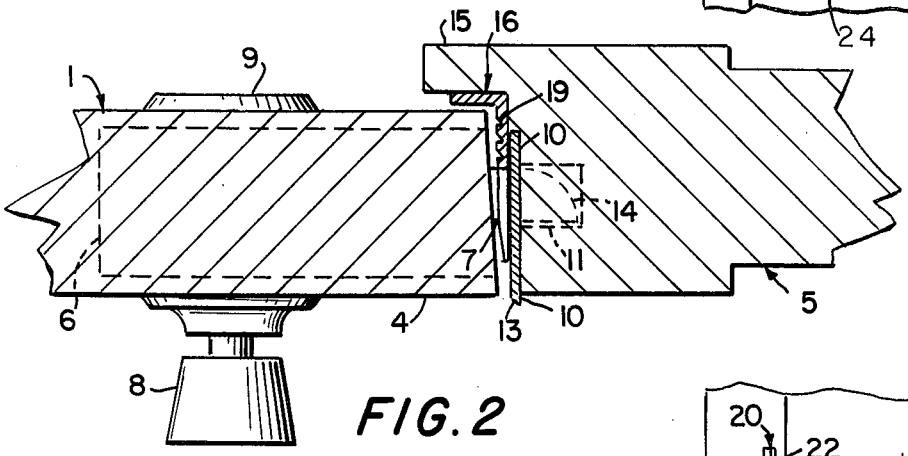
FIG. 2 shows a horizontal sectional view of the door in its closed position.

It will be noted from FIG. 4 that the fitting 16 includes two fastening lugs 17 through which the screws 26 extend. The portions 21 of the members 20 are clamped between the lugs 17 and the striker plate 10. As is conventional with good quality doors, the edge of the stile 4 is inclined slightly with respect of a line extending perpendicular to the front and rear faces of the door. This can be seen in FIGS. 2 and 3. In view of this feature, the thickness of the lugs 17 decreases in the direction away from the base of the L, and the width of the web portions 23 decreases in the direction away from the base of the L so that the portions 22 are not parallel to the portions 21 but are inclined with respect thereto so as to be substantially parallel to the inclined outer surfaces of the lugs 17 and the edge of the stile 4.

Although it is preferable that the door should be provided with the fitting 16 and with the two members 20, and that each of the members should be provided with oblique slots and with the two V-shaped, bent out parts, these features are not essential. Since it is usual for a tamperer to introduce the strip of pliable material above the lock and draw it down into engagement with the camming surface of the bolt, the fitting 16 and the lower member need not be provided, and the upper member need not be formed with the two V-shaped, bent out parts. The slots in the portion 22 of the upper member need not be oblique, so long as they are sized and shaped to receive the leading edge of a suitable strip of pliable material. If the fitting 16 is not provided, the portions 21 of the members 20 would be clamped between the striker plate and the door jamb. The striker plate is let into a recess in the door jamb, and it is for this reason that the edge of the portion 22 that is nearer the lip 15 is aligned with the corresponding edge of the striker plate and is not adjacent the lip 15.

It will be noted that outermost corner of each portion 22 is rounded slightly. This is in order to avoid injuring persons passing through the doorway and to avoid snagging their clothing.

It is preferred that the members 20 should be made of brass, since a planar sheet of brass can be readily cut and bent into the desired configuration. This enables the portions 22 to be bent away from the door jamb in the even that the gap between the door jamb and the door stile is greater than usual.

It is to be understood that the invention is not limited to the specific constructions shown and described, since it will be apparent to those skilled in the art that changes may be made without departing from the principles of the invention as defined in the appended claims.

I claim:

1. A device for rendering a spring-loaded, sliding bolt lock resistant to tampering, comprising a sheet form member which can be mounted between the door stile and the door jamb and is formed with slots so that when a strip of pliable material is inserted between the door stile and the door jamb at a position spaced from the lock and is moved towards the lock, the leading edge of the sheet engages one of the slots in said member, said member having a first planar portion in which said slots are formed and a second planar portion for attachment of the member to the door jamb, the first and second planar portions being substantially parallel to one another and connected together by a web portion which extends substantially perpendicularly to the first and second planar portions.

2. A device as claimed in claim 1, wherein said slots extending through said first planar portion obliquely to the plane of said first planar portion.

3. A device as claimed in claim 1, wherein said first planar portion is also formed with at least one bent out part for impeding movement of the forward end of a strip of pliable material across said first planar portion, transversely to said slots.

4. A structure comprising a door having a door stile, a spring-loaded, sliding bolt lock fitted to the door stile, a door jamb adjacent to the door stile, and a sheet form member which is disposed between the door stile and the door jamb and has an edge which is spaced from the bolt of the lock and extends transversely to the door stile and the door jamb, said sheet form member extending from said edge towards the bolt of the lock and being formed in said edge with slots extending substantially parallel to the door stile and door jamb, said slots terminating at positions spaced from said bolt.

5. A structure as claimed in claim 4, wherein said member includes a planar portion in which said slots are formed, said slots extending through said planar portion obliquely to the plane of said planar portion.

6. A device as claimed in claim 4, wherein said member has a planar portion in which said slots are formed, said planar portion being formed also with at least one bent out part for impeding movement of the forward end of a strip of pliable material across said planar portion, transversely to said slots.

7. A device as claimed in claim 4, wherein said member has a first planar portion in which said slots are formed, a second planar portion for attachment of the member to the door jamb, the first and second planar portions being substantially parallel to one another and connected together by a web portion which extends substantially perpendicularly to the first and second planar portions

8. A structure as claimed in claim 4, further comprising a second similar sheet form member which is disposed between the door stile and the door jamb, on the opposite side of the bolt of the lock from the sheet form member recited in claim 4, and has an edge which is spaced from the bolt of the lock and extends transversely to the door stile and the door jamb, said second sheet form member extending from said edge towards the bolt of the lock and being formed in said edge with slots extending substantially parallel to the door stile and the door jamb, said slots terminating at positions spaced from said bolt.

* * * * *